US005469927A

United States Patent [19]

Griffin

[11] Patent Number: 5,469,927

[45] Date of Patent: Nov. 28, 1995

[54] CUTTING ELEMENTS FOR ROTARY DRILL BITS

[75] Inventor: Nigel D. Griffin, Whitminster, England

[73] Assignee: Camco International Inc., Houston, Tex.

[21] Appl. No.: 163,344

[22] Filed: Dec. 7, 1993

[30] Foreign Application Priority Data

Dec. 10, 1992 [GB] United Kingdom ..... 9225779

[51] Int. Cl.[6] ..... E21B 10/46

[52] U.S. Cl. ..... 175/432

[58] Field of Search ..... 175/433, 432, 175/430, 428; 51/293, 297

[56] References Cited

U.S. PATENT DOCUMENTS

| | | | |
|---|---|---|---|
| 4,109,737 | 8/1978 | Bovenkerk | 175/329 |
| 4,604,106 | 8/1986 | Hall et al. | 51/293 |
| 4,694,918 | 9/1987 | Hall | 175/329 |
| 4,716,975 | 1/1988 | Dennis | 175/329 |
| 4,718,505 | 1/1988 | Fuller | 175/329 |
| 4,764,434 | 8/1988 | Arunsson et al. | 428/565 |
| 4,784,023 | 11/1988 | Dennis | 76/108 A |
| 4,811,801 | 3/1989 | Salesky et al. | 175/329 |
| 4,861,350 | 8/1989 | Phaal et al. | 175/426 |
| 4,959,929 | 10/1990 | Burnand et al. | 51/307 |
| 5,007,207 | 4/1991 | Phaal | 51/295 X |
| 5,011,515 | 4/1991 | Frishour | 51/307 |
| 5,090,492 | 2/1992 | Keith | 175/410 |
| 5,120,327 | 6/1992 | Dennis | 51/293 |
| 5,248,317 | 9/1993 | Tank et al. | 51/293 |

FOREIGN PATENT DOCUMENTS

| | | | |
|---|---|---|---|
| 0133386 | 2/1985 | European Pat. Off. . | |
| 0219959 | 4/1987 | European Pat. Off. . | |
| 0235455 | 9/1987 | European Pat. Off. . | |
| 0312281 | 4/1989 | European Pat. Off. . | |
| 0462955 | 12/1991 | European Pat. Off. . | |
| 0462091 | 12/1991 | European Pat. Off. | 175/426 |
| 2151283 | 7/1985 | United Kingdom . | |
| 2216577 | 10/1989 | United Kingdom . | |
| 2228031 | 8/1990 | United Kingdom . | |
| 2261894 | 6/1993 | United Kingdom | 175/433 |
| 9215427 | 9/1992 | WIPO . | |

*Primary Examiner*—Hoang C. Dang

[57] ABSTRACT

A preform cutting element, particularly for a drag-type rotary drill bit, comprises a thin cutting table of polycrystalline diamond, a substrate of cemented tungsten carbide, and a transition layer between the cutting table and substrate, the cutting table, transition layer, and substrate having been bonded together in a high pressure, high temperature press. The interface between the cutting table and the transition layer is configured and non-planar to reduce the risk of spalling and delamination of the cutting table. The interface between the transition layer and substrate may also be configured, and various methods are described for manufacturing the element with the non-planar interface.

12 Claims, 4 Drawing Sheets

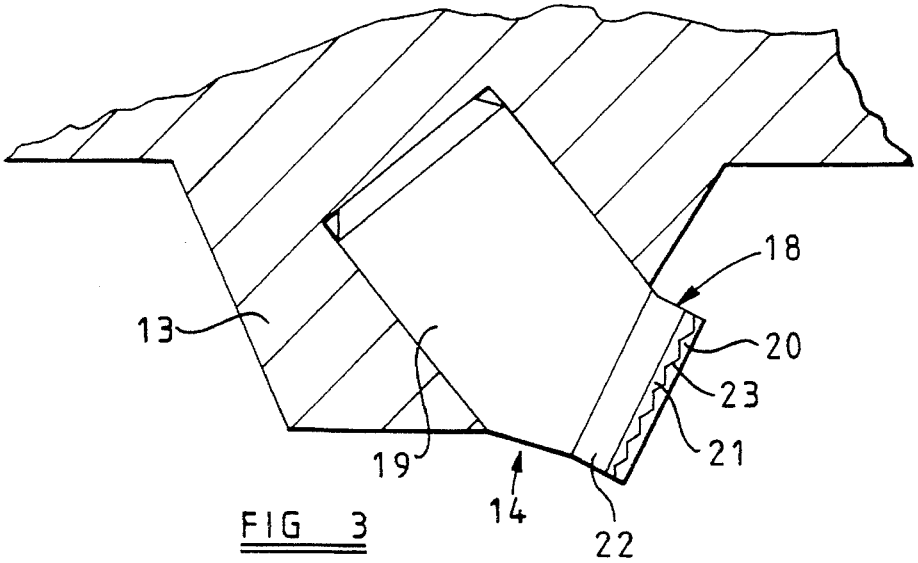
FIG 3
FIG 4
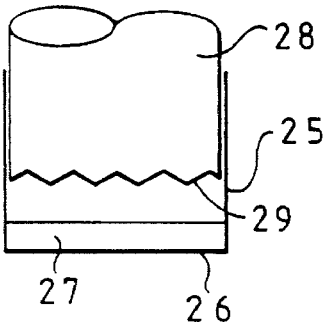
FIG 5
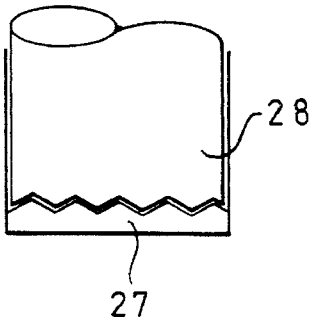
FIG 6
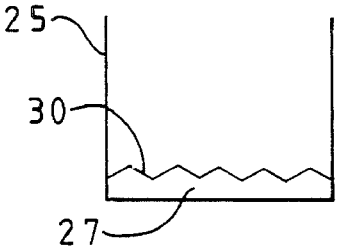
FIG 7
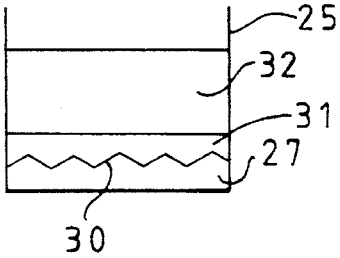
FIG 8
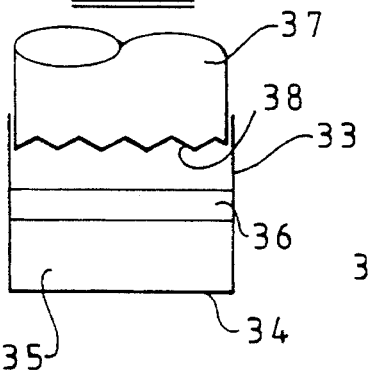
FIG 9
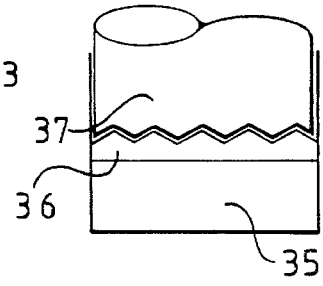

FIG 10
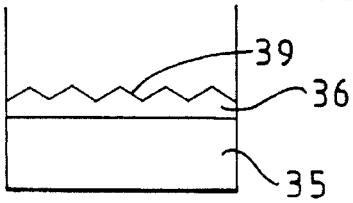
FIG 11
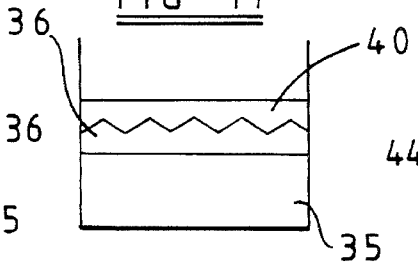
FIG 12
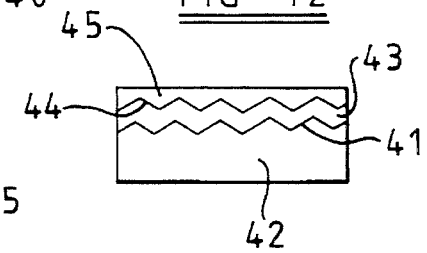
FIG 13
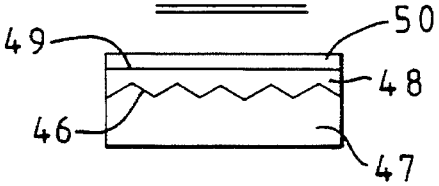
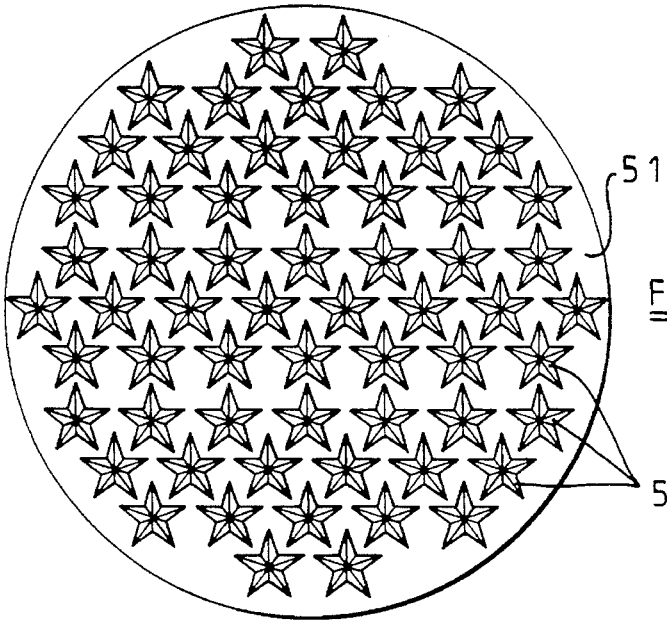
FIG 15
FIG 14
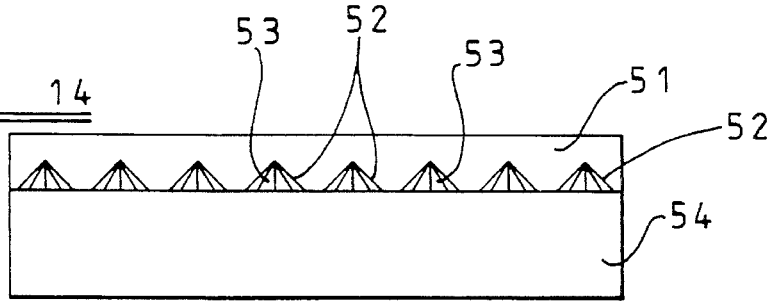

CUTTING ELEMENTS FOR ROTARY DRILL BITS

BACKGROUND OF THE INVENTION

The invention relates to cutting elements for rotary drill bits of the kind used for drilling or coring holes in subsurface formations. The invention may be applied to a number of different kinds of rotary drill bits, including drag bits, roller cone bits and percussion bits.

By way of example, the invention will be primarily described in relation to cutting elements for use on rotary drill bits of the kind comprising a bit body having a shank for connection to a drill string and an inner passage for supplying drilling fluid to the face of the bit, the bit, body carrying a plurality of cutting elements. Each cutting element comprises a preform element, often in the form of a circular tablet, including a cutting table of superhard material having a front cutting face and a rear face, the rear face of the cutting table being bonded to a substrate of material which is less hard than the superhard material.

The cutting table, which is normally in the form of a single layer, usually comprises polycrystalline diamond, although other superhard materials are available, such as cubic boron nitride. The substrate of less hard material is often formed from cemented tungsten carbide, and the cutting table and substrate are bounded together during formation of the cutting element in a high pressure, high temperature forming press. This forming process is well known and will not be described in detail. The interface between the superhard cutting table and the substrate is usually flat and planar.

Each preform cutting element is normally mounted on a carrier in the form of a generally cylindrical stud or post received in a socket in the bit body. The carrier is often formed from cemented tungsten carbide, the surface of the substrate being brazed to a surface on the carrier, for example by a process known as "LS bonding". The bit body itself may be machined from metal, usually steel, or may be moulded using a powder metallurgy process.

Such cutting elements are subjected to extremes of temperature and heavy loads when the drill is in use down a borehole. It is found that under drilling conditions spalling and delamination of the superhard cutting table can occur, that is to say the separation and loss of the diamond or other superhard material over the cutting surface of the table.

One feature which is believed to increase the occurrence of spalling and delamination is the fact that the superhard layer and its substrate have different material properties, such as different coefficients of expansion, elastic modulus etc., leading to high levels of stress at or near the interface between the two layers. Also, it is believed that, during drilling, shock waves may rebound from the internal planar interface between the two layers and interact destructively, leading to component failure. The combination of these effects is believed to result in spalling and delamination of the cutting table at lower energies that might otherwise be the case. Indeed, the problem is so bad on occasions that polycrystalline diamond layers have been known to delaminate spontaneously from the substrate as a result of residual stresses alone.

One method which has been employed to overcome the worst of this problem is disclosed in U.S. Pat. No. 4,784,023. According to the disclosure in this patent, there is employed a non-planar interface between a polycrystalline diamond layer and a cemented tungsten carbide substrate.

Typically this takes the form of grooves ground into the surface of the carbide substrate, on to which the polycrystalline diamond layer is subsequently formed. The grooves act to increase the surface area of attachment and give a non-planar interface zone between the diamond and carbide. It is also known, although not in cutting elements of the kind last referred to, to provide one or more transitional layers between the cutting table and substrate, and these are known to improve the attachment of the cutting table to the substrate. Such transition layers are used to facilitate the production of cutters having curved geometries, such as domed cutters, which may be difficult to make without some form of transitional zone. However, hitherto the interfaces between such transition layers and the cutting table and substrate have been planar, or smoothly curved in the case of domed cutters.

The object of the present invention is to provide a new and improved preform cutting element which may overcome or reduce the spalling and delamination problems referred to above. The invention also provides methods of manufacturing such preform cutting elements which may be simpler and less costly than the manufacturing methods used hitherto.

SUMMARY OF THE INVENTION

According to one aspect of the invention there is provided a preform cutting element comprising a thin cutting table of superhard material, a substrate of material which is less hard than the superhard material, and at least one transition layer between the cutting table and substrate, the cutting table, transition layer and substrate having been bonded together in a high pressure, high temperature press, and there being provided a configured non-planar interface between the cutting table and the transition layer.

Preferably the superhard material is polycrystalline diamond and the substrate is cemented tungsten carbide.

Preferably the transition layer has at least one material property the characteristics of which are intermediate the characteristics of the same property of the cutting table and substrate respectively. For example, the transition layer may have a coefficient of thermal expansion and/or an elastic modulus intermediate that of the cutting table and substrate. Where the cutting table is polycrystalline diamond and the substrate is tungsten carbide the transition material may comprise a layer of bonded particles of polycrystalline diamond, tungsten carbide and cobalt. The layer may initially comprise particles of diamond, tungsten metal and cobalt, the tungsten metal becoming converted to tungsten carbide in the course of the high temperature, high pressure forming process.

The transition layer may extend over only a portion of the adjacent surfaces of the cutting table and substrate. For example, the material of the transition layer may be located in a recess extending over a part of the surface of the cutting table, the part of said surface outside the recess being bonded directly to the substrate.

The invention also provides a method of forming a preform cutting element according to the invention, the method comprising the steps of moulding a configured non-planar surface on a layer of particles of superhard material, applying to said configured surface a layer of particles of material to form a transition layer, whereby said particles fill recesses between projections in the configured surface, applying a layer of substrate material to the transition layer, and subjecting the layers to pressure and temperature in a high pressure, high temperature press to bond the layers together.

Said configured non-planar surface may comprise a recess formed in the superhard layer, said recess then being filled with said transition layer particles.

The layer of superhard particles may be moulded with said configured non-planar surface by placing the layer in an open mould to leave a surface of the layer exposed, and applying to the exposed surface of the layer a tool shaped to impart said configured non-planar shaped surface thereto.

The mould may be the mould in which the preform is to be formed in the high pressure, high temperature press, in which case the particles to form the transition layer are applied to the configured nonplanar surface of the superhard layer while it remains in the mould.

Alternatively, the layer of superhard particles may include a binder material which binds the diamond particles together when pressure is applied to the layer by said shaped tool, thereby producing a self-supporting diamond layer, the method then including the further step of removing the self-supporting layer from the open mould and transferring it to a second mould in which the transition layer particles and substrate material are added and the preform formed in a high pressure, high temperature press.

In another method according to the invention a configured non-planar surface is formed on a layer of particles of transition layer material, a layer of superhard particles then being applied to the transition layer.

The configured transition layer may comprise a solid transition layer preformed with said configured non-planar surface. For example, the layer may be moulded using a powder metallurgy process, or may be machined from a solid layer of material. Alternatively, a layer of transition material particles may include a binder material which binds the particles together when pressure is applied to the layer by a shaped tool, thereby producing a self-supporting transition layer, which is then transferred to the mould in which the cutting element is formed.

Alternatively, the method may include the steps of applying a layer of particles of transition layer material to a layer of substrate material in an open mould to leave a surface of the transition layer exposed, applying to the exposed surface of the transition layer a tool shaped to impart said configured non-planar shape to the surface, applying to said configured surface a layer of superhard material particles, and then subjecting the layers to pressure and temperature in a high pressure, high temperature press to bond the layers together.

The invention further includes within its scope a preform cutting element comprising a thin superhard cutting table, a substrate of a material which is less hard than the superhard material, and at least one transition layer between the cutting table and the substrate, the cutting table, transition layer and substrate having been bonded together in a high pressure, high temperature press, and there being provided a configured non-planar interface between the substrate and the transition layer.

The latter arrangement may be combined with any of the previously mentioned arrangements so that a configured non-planar interface is provided both between the substrate and the transition layer and between the transition layer and the superhard cutting table.

BRIEF DESCRIPTION OF THE DRAWINGS

FIG. 3 is a side elevation of a typical cutter assembly incorporating a cutter element according to the invention, FIGS. 4–7 are diagrammatic sections through a mould showing steps in one method of forming a cutting element according to the invention, FIGS. 8–11 are similar views showing an alternative method according to the invention, FIGS. 12 and 13 are sections through further cutting elements in accordance with the invention, FIG. 14 is a diagrammatic section through another cutting element in accordance with the invention, FIG. 15 is a plan view of the superhard cutting table of the element of FIG. 14, before the application of the transition layer and substrate.

DETAILED DESCRIPTION OF THE PREFERRED EMBODIMENTS

Figure 1:
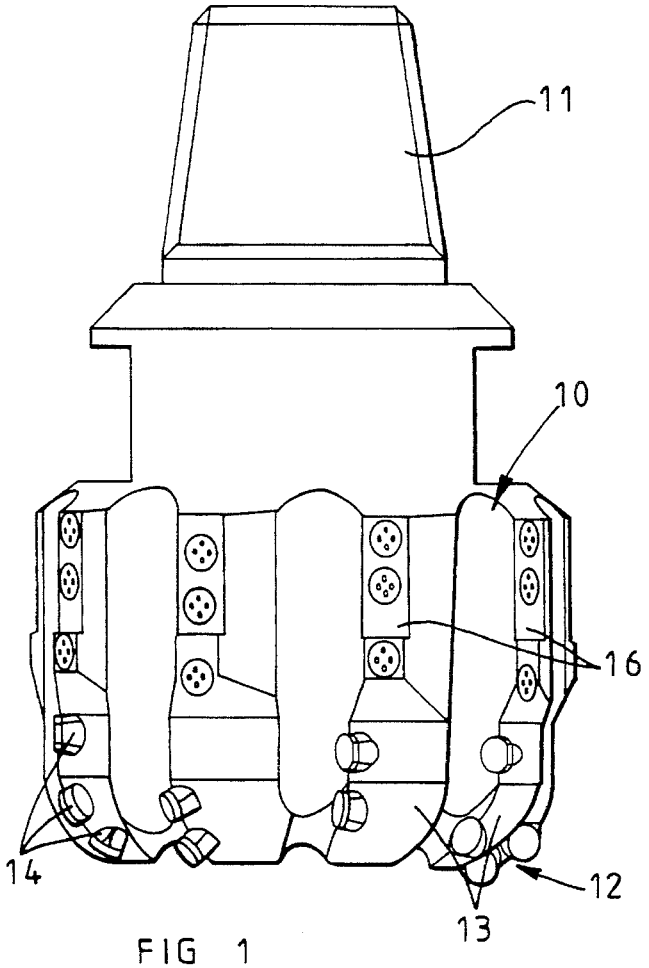
FIG. 1 is a side elevation of a typical drag-type drill bit in which cutting elements according to the present invention may be used.
Figure 2:
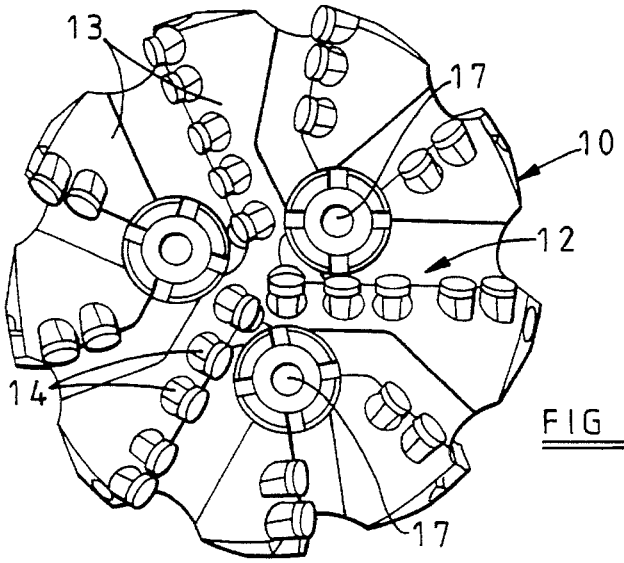
FIG. 2 is an end elevation of the drill bit shown in FIG. 1.

FIGS. 1 and 2 show a typical full bore drag bit of a kind to which cutting assemblies of the present invention are applicable. The bit body 10 is machined from steel and has a shank formed with an externally threaded tapered pin 11 at one end for connection to the drill string. The operative end face 12 of the bit body is formed with a number of blades 13 radiating from the central area of the bit, and the blades carry cutter assemblies 14 spaced apart along the length thereof. The bit has a gauge section including kickers 16 which contact the walls of the borehole to stabilise the bit in the borehole. A central passage (not shown) in the bit body and shank delivers drilling fluid through nozzles 17 in the end face 12 in known manner.

As shown in greater detail in FIG. 3, each cutter assembly 14 comprises a preform cutting element 18 mounted on a carrier 19 in the form of a post which is located in a socket in the bit body, Each preform cutting element is in the form of a circular tablet comprising a thin facing table 20 of superhard material, usually polycrystalline diamond, bonded to a transition layer 21, which is in turn bonded to a substrate 22, for example of cemented tungsten carbide. The rear surface of the substrate is bonded, for example by LS bonding, to a suitably orientated surface on the post 19.

For clarity, the thickness of the layers is exaggerated in FIG. 3, as well as in FIGS. 4 to 15. In the following description the superhard layer will usually be referred to, for convenience, as a diamond layer, and the substrate will be referred to as comprising tungsten carbide. However, it will be appreciated that any other suitable material may be used for these layers. The material of the transition layer may also differ from that specifically described in the examples.

In accordance with the invention, the interface 23 between the diamond layer 20 and transition layer 21 is of configured non-planar form. In the arrangement shown in FIG. 3 the interface between the transition layer 21 and substrate 22 is planar, although the invention includes within its scope arrangements where this interface also is configured and non-planar.

The transition layer is preferably formed from a material which has properties the characteristics of which are intermediate the characteristics of the same properties of the diamond table 20 and substrate 22. For example, the transition layer may have a coefficient of thermal expansion, and/or an elastic modulus, intermediate that of polycrystalline diamond and tungsten carbide. The transition layer may comprise a compound of polycrystalline diamond, tungsten carbide and cobalt.

In FIG. 3, and also in FIGS. 4–13, the configured non-planar shape of the interface between the diamond layer and transition layer is indicated, for convenience, by a zig-zag line around the periphery or across the section of the layer or layers. However, it should be understood that this is merely a diagrammatic representation and that, in practice, many different forms of configured surface may be employed. For example, the surface may comprise a plurality of parallel similar grooves extending across the surface. Such grooves may be of any suitable cross-sectional shape, and if they are V-shaped the appearance will be substantially as shown in FIGS. 3–13. However, the configured surface could be formed by grooves of any other cross-sectional shape and layout. For example, grooves of increasing width and/or depth might extend radially outwards from the centre of the layer in which they are formed. Alternatively, the layer may be formed with a plurality of individual projections and/or recesses formed in a regular or irregular array over the surface of the layer. In another form of the invention the configured surface may be provided by forming a single large shaped recess in the layer, and one example of such arrangement will be described in relation to FIGS. 14 and 15.

Alternative methods of forming a cutting element in accordance with the invention will now be described with reference to FIGS. 4–7 and FIGS. 8–11.

Referring to FIG. 4, there is shown diagrammatically an open circular mould 25 having a-flat bottom 26. A layer 27 of polycrystalline diamond particles is placed in the bottom of the mould and there is then introduced into the mould a cylindrical tool 28 having a lower configured non-planar surface 29.

As shown in FIG. 5, the tool 28 is forced downwardly on to the layer 27 so that when removed from the mould 25, as shown in FIG. 6, the diamond layer 27 has an upper configured non-planar surface 30 which is the negative of the surface 29 on the bottom of the tool 28.

The mould 25 may be of known kind which is suitable for use in forming a preform cutting element in a high pressure, high temperature press. In this case the next step, as shown in FIG. 7, is to apply to the upper surface of the diamond layer 27 a layer 31 of a suitable transition material, in particulate form. The material in the layer 31 fills the depressions between the projections on the configured surface 30 on the diamond layer so as to provide a configured non-planar interface between the two layers. The upper surface of the transition layer 31 is flat and a layer 32 of substrate material, such as cemented tungsten carbide, is applied to the upper surface of the transition layer. Normally the substrate layer 32 will be in the form of a preformed solid disc, but the invention includes arrangements where the layer 32 is also initially in particulate form. The layers are then compressed within the mould under extremely high temperature and pressure to produce the finished preform cutting element. Such forming process is well known in itself and does not form a part of the present invention.

In a modified version of the method of FIGS. 4–7, the polycrystalline diamond particles forming the layer 27 are mixed with a small proportion (say ½%) of a wax powder or similar organic binder so that when the layer 27 has been compressed by the tool 28 the layer is self-supporting, the diamond particles being bound together by the binder material. In this case the layer 27 may be preformed with its configured non-planar surface and the preformed disc may be subsequently transferred to the actual mould where the other layers are applied and where the forming process takes place as shown in FIG. 7.

FIGS. 8–11 show an alternative method of forming the cutting element. Referring to FIG. 8, there is again provided a mould 33 having a flat bottom 34. There is first introduced into the mould a substrate layer 35 which, as before, may comprise a solid preformed disc of cemented tungsten carbide or other suitable substrate material, or a layer of particulate material of suitable form.

There is then applied to the top of the substrate layer 35 a transition layer 36 comprising suitable transition layer material in particulate form. A tool 37 having a lower configured non-planar surface 38 is then introduced into the mould 33 and pressed down on to the surface of the transition layer 36, as shown in FIG. 9, to form thereon a configured non-planar upper surface 39 as shown in FIG. 10. There is then applied to this configured upper surface a layer 40 of polycrystalline diamond particles as shown in FIG. 11. The cutting element is then formed in the high pressure, high temperature press in the usual way.

Instead of the transition layer 36 being moulded with the configured surface while in the mould 33, as shown in FIGS. 9 and 10, it may be preformed with the configured surface before being inserted in the mould. For example, particulate transition layer material mixed with a suitable binder, such as wax powder, may be compressed into a self-supporting tablet having a configured surface on one side, in similar fashion to the method described above for premoulding the diamond layer. The self-supporting tablet may then be introduced into the forming mould and the polycrystalline diamond particles applied thereto as shown in FIG. 11.

Alternatively, the transition layer may comprise a solid disc which is preformed with the required configured surface on one side. For example, the surface configuration may be ground or otherwise machined on to the surface of the solid disc of transition layer material.

In the arrangements described above the interface between the substrate 32 and 35 and the transition layer 31 or 36 is generally planar. However, according to another aspect of the present invention, the interface between the substrate and transition layer may also be configured and non-planar. Such an arrangement is shown diagrammatically in FIG. 12 wherein there is a configured non-planar interface 41 between the substrate 42 and the transition layer 43 and a further non-planar interface 44 between the transition layer 43 and the polycrystalline diamond layer 45.

The interface 41 may be formed by machining an appropriate configured non-planar surface on to a solid substrate 42 and then applying particulate transition layer material to that substrate in the mould. Alternatively, the interface 41 may be formed by similar methods to those described above in relation to FIGS. 4–11 for forming the interface between the transition layer and the diamond layer.

FIG. 13 shows an arrangement where a configured non-planar interface 46 is provided only between the substrate 47 and the transition layer 48, and the interface 49 between the transition layer 48 and the diamond layer 50 is generally planar.

FIGS. 14 and 15 show another and preferred form of cutting element in accordance with the invention. In this case the non-planar configuration of the polycrystalline diamond layer 51 comprises a plurality of recesses 52 spaced apart over the diamond layer, each recess, as best seen in FIG. 15, being in the form of a five pointed star. The recesses 52 may be formed by a suitably shaped tool in the method described in relation to FIGS. 4–7 above. The recesses 52 are then filled with transition material 53 in particulate form and the substrate 54 is then applied over the top of the filled recesses, whereafter the assembly is subjected to high pressure and temperature to form the cutting element.

Other shapes of recess 52 may be employed. In the arrangement shown the particulate transition layer material merely fills the recesses 52, so that the surface of the diamond layer outside the recesses is bonded directly to the substrate. However, the invention does not exclude arrangements where transition layer material is applied to a greater depth so as also to extend across the surface of the diamond layer 51 outside the recesses 52.

Figure 16:
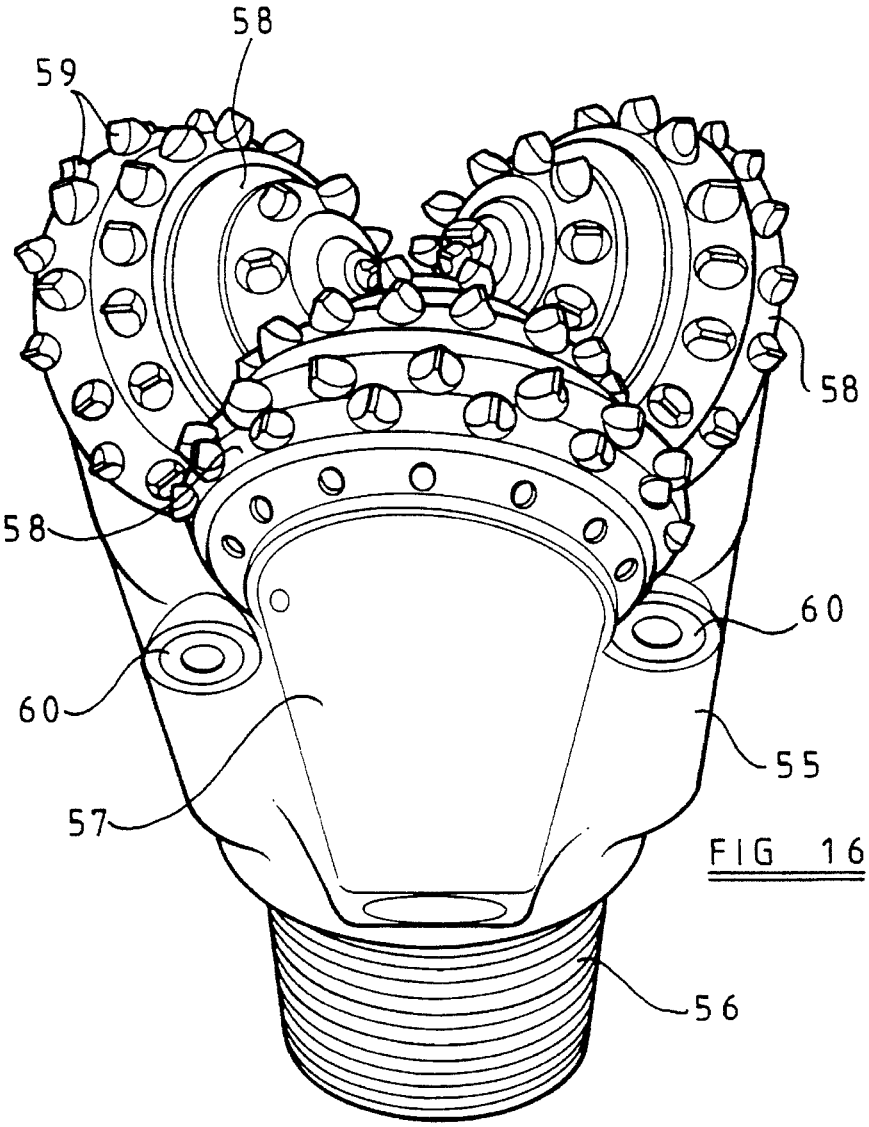
FIG. 16 is a perspective view of a typical roller cone drill bit of a kind in which cutting elements according to the invention may also be used.

As previously mentioned, cutting elements in accordance with the invention, including some of the embodiments described above, may be used as cutting elements in roller cone and percussion drill bits. FIG. 16 is a diagrammatic view of one form of typical roller cone drill bit of a kind to which cutting elements according to the invention may be applied.

As is well known, the roller cone bit comprises a bit body 55 having a threaded pin 56 for connection to a drill string and three equally spaced depending legs 57 which carry inwardly inclined journals (not shown) on which are rotatably mounted respective roller cones 58.

Each roller cone 58 carries a number of peripheral rows of cutting elements 59 secured, for example by interference fitting, within sockets in the surface of the cones 58. Nozzles 60 in the bit body deliver jets of drilling fluid on to the roller cones and the bottom of the borehole to clean and cool the cutting elements and also to carry away to the surface the cuttings from the bottom of the borehole.

As the roller cones 58 rotate, the cutting elements 59 tend to break up the formation at the bottom of the hole with a crushing action. The cutting elements therefore project away from the surface of the roller cone bodies. For this reason, cutting elements according to the invention which will be particularly suitable for roller cone bits are those where the front cutting surface of the cutting element is domed or pointed. Two such cutting elements are shown diagrammatically, by a way of example, in FIGS. 17 and 18.

Figure 17:
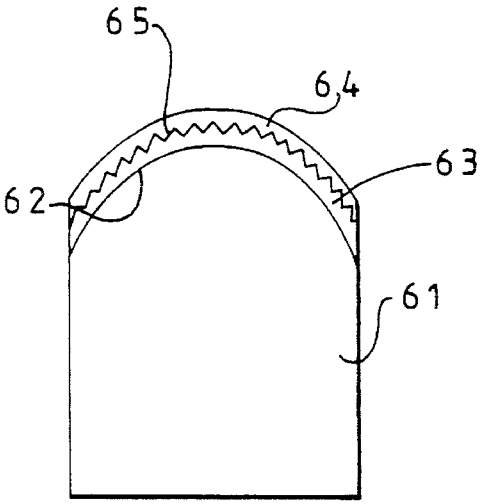
FIGS. 17 and 18 are diagrammatic sections through further forms of cutting element in accordance with the invention and of a kind suitable for use on roller cone or percussion bits, as well as drag bits.

In the embodiment of FIG. 17 the substrate 61 has an hemispherically domed surface 62 to which is applied a transition layer 63 and a superhard cutting layer 64, the transition and superhard layers being separated by a curved non-planar interface indicated at 65.

The cutting element is generally of circular cross-section and the axial length of the substrate 61 is substantial so that it may be received in a socket in the surface of the drill bit, for example in the cone of a roller cone drill bit, leaving the domed portion of the cutting elements projecting from the surface of the drill bit.

The materials of the substrate 61, transition layer 63 and superhard layer 64 may be of any of the kinds previously referred to, and the cutting element may be manufactured by any of the methods described above in relation to FIGS. 4–13. It will be appreciated that, using such methods, the configured surface of the forming tool will require to be convex or concave depending on the particular method used.

Although the interface 65 is shown as having a generally zig-zag configuration in FIG. 17, this is merely by way of example and any appropriate non-planar configuration may be employed. Thus, the zig-zag configuration may represent linear channels extending generally parallel from one side of the cutting table to the other, or concentric circular grooves, spiral grooves, or grooves radiating outwardly from the central axis of the interface.

Figure 18:
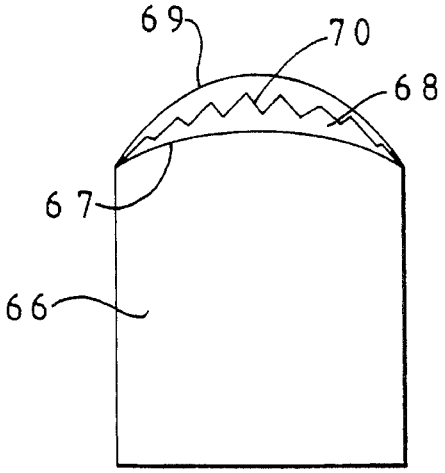

In the arrangement of FIG. 17 both the transition layer 63 and the superhard layer 64 are each of generally constant thickness, when considered with respect to a central plane of the interface 65. FIG. 18 shows an alternative arrangement where the substrate 66 has a more shallowly domed end surface 67 and where both the transition layer 68 and superhard layer 69 taper in thickness towards the outer periphery of the layers, having regard to the imaginary central plane of the configured interface 70 between the two layers. Again, the cutting elements of FIG. 18 may be formed from any of the materials, and by any of the methods, previously described.

The cutting elements of FIGS. 17 and 18 are by way of example only and other forms of cutting element having convex cutting faces may be employed in accordance with the invention. For example, the cutting face of the superhard layer, and the end face of the underlying substrate, may be conical, frusto conical or otherwise more pointed than the domed arrangements shown. Also, the cutting face need not necessarily be a surface of rotation, as in the embodiments of FIGS. 17 and 18, but may be asymmetrical. For example the cutting face may be generally chisel-shaped as shown by the cutting elements 59 in FIG. 16. Such cutting elements may also be manufactured in accordance with the invention by appropriate shaping of the substrate and forming tool.

Cutting elements having convex cutting surfaces, of the kind shown in FIGS. 16–18, are not exclusively for use with roller cone bits and may also be used, in some circumstances, in percussion drill bits and drag bits.

In the arrangements described above the superhard layer extends across the whole of the front surface of the cutting element, but the invention does not exclude arrangements where the superhard layer is formed with apertures, or is formed from separate elements, so that material of the transition layer extends through the superhard layer to form part of the front cutting face of the finished cutting element.

As previously mentioned, any suitable materials may be used for the superhard layer, the transition layer and substrate. The superhard layer may, a described above, comprise polycrystalline diamond, but cubic boron nitride layers may also be employed. The substrate will normally be formed from cemented tungsten carbide, but the invention does not exclude the use of other materials. A preferred material for the transition layer comprises a milled compound of polycrystalline diamond, tungsten carbide and cobalt, as referred to above, but the transition layer might also include crushed cemented tungsten carbide.

As previously described, the initial materials for the transition layer may comprise polycrystalline diamond, tungsten metal and cobalt, the tungsten metal becoming converted to tungsten carbide during formation of the cutting element in the high pressure, high temperature press. However, in such an arrangement an excess of tungsten metal powder may be provided so that not all of the tungsten metal converts to tungsten carbide, and the final transition layer therefore includes some tungsten metal. This may inhibit the graphitisation of the substrate which might otherwise occur.

I claim:

1. A preform cutting element comprising a thin cutting table of superhard material, a substrate of material which is less hard than the superhard material, and at least one transition layer between the cutting table and substrate, the cutting table, transition layer and substrate having been bonded together in a high pressure temperature press, the transition layer varying in thickness across the cutting element in a manner to provide a plurality of projections on the transition layer which project into the material of the cutting table and provide a configured non-planar interface between the cutting table and the transition layer.

2. A cutting element according to claim 1, wherein the superhard material is polycrystalline diamond and the substrate is cemented tungsten carbide.

3. A cutting element according to claim 1, wherein the transition layer has at least one material property the characteristics of which are intermediate the characteristics of the same property of the cutting table and substrate respectively.

4. A cutting element according to claim 3, wherein the transition layer has at least one of a coefficient of thermal expansion and an elastic modulus intermediate that of the cutting table and substrate.

5. A cutting element according to claim 1, wherein the cutting table is polycrystalline diamond and the substrate is tungsten carbide and the transition material comprises a layer of bonded particles of polycrystalline diamond, tungsten carbide and cobalt.

6. A cutting element according to claim 1, wherein the transition layer extends over only a portion of the adjacent surfaces of the cutting table and substrate.

7. A cutting element according to claim 6, wherein the material of the transition layer is located in a recess extending over a part of the surface of the cutting table, the part of said surface outside the recess being bonded directly to the substrate.

8. A preform cutting element comprising a thin superhard cutting table, a substrate material which is less hard than the superhard material, and at least one transition layer between the cutting table and the substrate, the cutting table, transition layer and substrate having been bonded together in a high pressure, high temperature press, the transition layer being substantially continuous across the cutting element and varying in thickness in a manner to provide a plurality of projections on the transition layer which project into the material of the substrate and provide a configured non-planar interface between the substrate and the transition layer.

9. A preform cutting element according to claim 8 wherein a configured non-planar interface is provided both between the substrate and the transition layer and between the transition layer and the superhard cutting table.

10. A perform cutting element comprising a thin cutting table of superhard material, a substrate of material which is less hard than the superhard material, and at least one transition layer between the cutting table and the substrate, the transition layer comprising a transition material which differs in composition from the materials of both the cutting table and the substrate, and the cutting table, transition layer and substrate having been bonded together in a high pressure, high temperature press, the transition layer being non-continuous and comprising regions where the transition material projects into recesses in the cutting table, and other regions where the material of the cutting table extends through the transition layer and is bonded directly to the substrate.

11. A preform cutting element comprising a thin cutting table of superhard material, a substrate of material which is less hard than the superhard material, and at least one transition layer between the cutting table and substrate, the transition layer comprising a transition material which differs in composition from the materials of both the cutting table and the substrate, and the cutting table, transition layer and substrate having been bonded together in a high pressure, high temperature press, the transition layer comprising a plurality of separate projections, spaced apart across the cutting element and bonded to the substrate, which projections extend into a plurality of corresponding recesses in the cutting table, the surface of the cutting table outside said recesses being bonded directly to the substrate.

12. A preform cutting element according to claim 11, wherein said projections and recesses are generally star-shaped.

* * * * *